United States Patent [19]

Kunkel

[11] 4,411,309

[45] Oct. 25, 1983

[54] HEAT EXCHANGER ASSEMBLY

[75] Inventor: Harold E. Kunkel, East Detroit, Mich.

[73] Assignee: Ex-Cell-O Corporation, Troy, Mich.

[21] Appl. No.: 244,459

[22] Filed: Mar. 16, 1981

[51] Int. Cl.[3] ..... F28F 9/00

[52] U.S. Cl. ..... 165/76; 29/157.3 D

[58] Field of Search ..... 165/76; 29/157.3 A, 29/157.3 B, 157.3 D, 411, 418

[56] References Cited

U.S. PATENT DOCUMENTS

| | | | |
|---|---|---|---|
| 1,706,982 | 3/1929 | Murray, Jr. et al. | 29/157.3 A |
| 1,767,605 | 6/1930 | Modine | 29/157.3 B |
| 2,788,195 | 4/1957 | Karmazin | 165/76 |
| 2,977,918 | 4/1961 | Kritzer | 29/157.3 B |
| 3,258,832 | 7/1966 | Gerstung | 165/176 |
| 3,295,598 | 1/1967 | Metzger | 165/76 |
| 3,472,316 | 10/1969 | Couch, Jr. | 29/157.3 B |
| 4,005,746 | 2/1977 | Young | 165/76 |
| 4,197,625 | 4/1980 | Jahoda | 29/157.3 V |

*Primary Examiner*—William R. Cline
*Assistant Examiner*—John M. Kramer
*Attorney, Agent, or Firm*—John P. Moran

[57] ABSTRACT

The disclosure illustrates and describes a heat exchanger arrangement including a plurality of individual heat exchanger assemblies, each including a fin pack confined between a pair of end plates having a plurality of openings formed therein, a plurality of tubes extended through the openings, and a plurality of end segments interconnecting adjacent pairs of tubes of each heat exchanger assembly. The plurality of individual heat exchanger assemblies are arranged as a predetermined number of adjacent pairs, and connector means serve to interconnect adjacent outer corners of each adjacent pair of assemblies during assembly and/or shipping.

4 Claims, 6 Drawing Figures

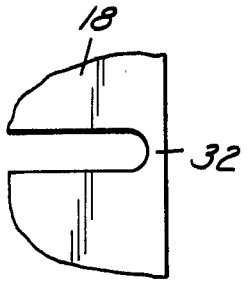
FIG.3
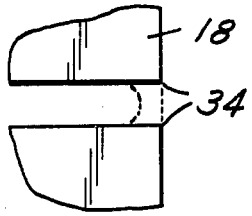
FIG.4
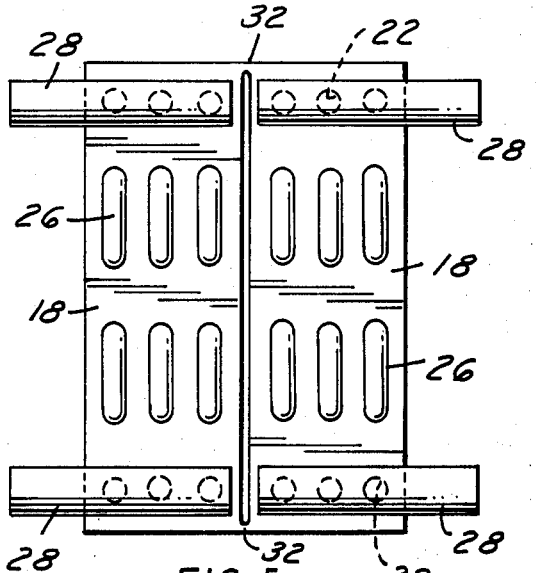
FIG.5
FIG.6
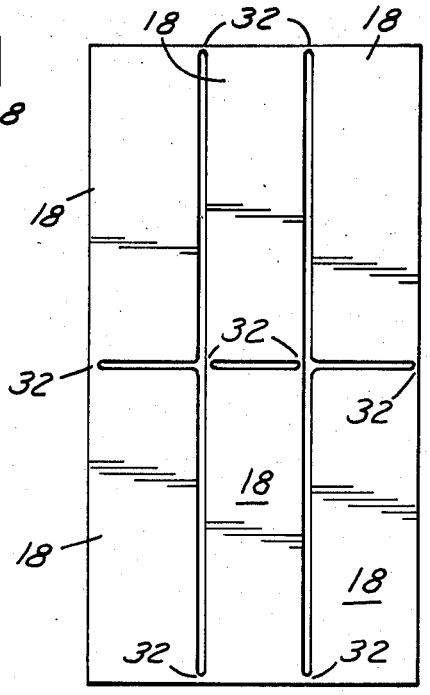

HEAT EXCHANGER ASSEMBLY

TECHNICAL FIELD

This invention relates generally to heat exchangers and, more particularly, to a multi-unit arrangement for assembling and shipping a plurality of units.

BACKGROUND ART

Heretofore, heat exchangers have been assembled one unit at a time. In other words, as a single unit, straight tubes are inserted through the end plates and fin pack, and expanded to obtain a tight bond with the fins. Bent end segments and lead tubes are then secured to the ends of the tubes in any suitable manner so as to produce a leak-proof assembly.

As the unit progresses through the assembly steps, substantial handling is involved, enhancing the possibility of damage to any exposed fin surfaces. Such damaged fins must be straightened before shipping. Beyond that, further damage is possible during and after shipment.

DISCLOSURE OF THE INVENTION

An object of this invention is to provide a heat exchanger assembly including improved means for protecting selected faces thereof.

Another object of the invention is to provide a heat exchanger assembly wherein two or more heat exchanger units are combined for assembly and shipping as a unit.

A further object of the invention is to provide a heat exchanger arrangement wherein four heat exchangers have the oppositely disposed end plates thereof formed as integral parts of two oppositely disposed large area plate members. Each of the latter plate members has intersecting slots formed along the longitudinal and lateral centerlines thereof. The ends of each slot extend to within a predetermined distance from the adjacent edges of the plate member, thereby providing four interconnected plate segments of equal areas.

Still another object of the invention is to provide a heat exchanger arrangement of four heat exchanger assemblies, each including a fin pack comfined between a pair of end plates having a plurality of aligned openings formed therein, a plurality of tubes extended through the aligned openings, a plurality of U-shaped end segments interconnecting adjacent pairs of tubes of each heat exchanger assembly, and the plurality of individual heat exchanger assemblies being arranged in a side-by-side relationship, with suitable connector straps or bridge tabs interconnecting adjacent outer corners of each adjacent pair of assemblies.

These and other objects and advantages of the invention will be apparent when reference is made to the following description and accompanying drawings, wherein:

BRIEF DESCRIPTION OF DRAWINGS

FIG. 3 is an enlarged view of a portion of the FIG. 1 arrangement;

FIG. 4 is a view similar to FIG. 3 in a different operational condition;

FIG. 5 is an end view of an alternate embodiment; and

FIG. 6 is an end view of a second alternate embodiment.

BEST MODE OF CARRYING OUT THE INVENTION

Figure 1:
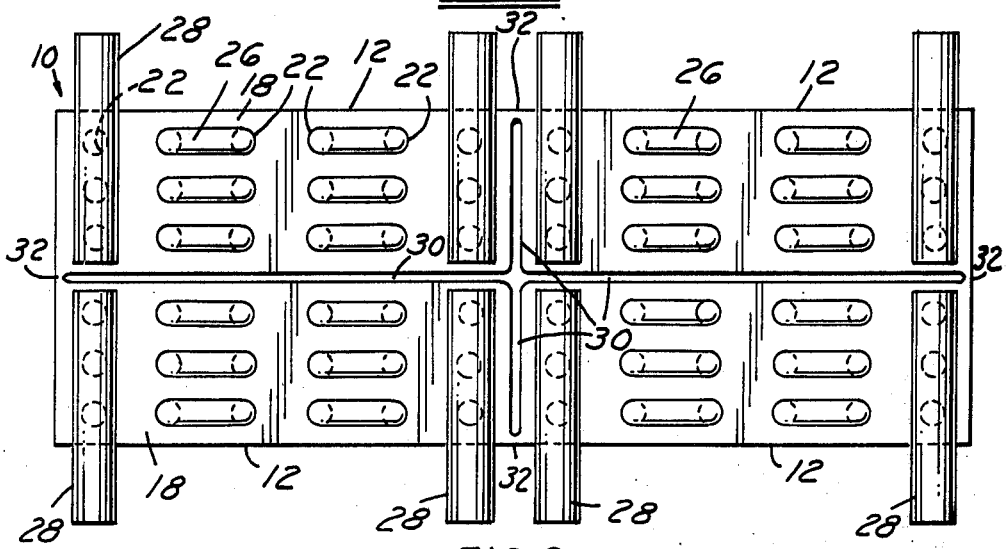
FIG. 1 is an end view of a heat exchanger arrangement embodying the invention.
Figure 2:
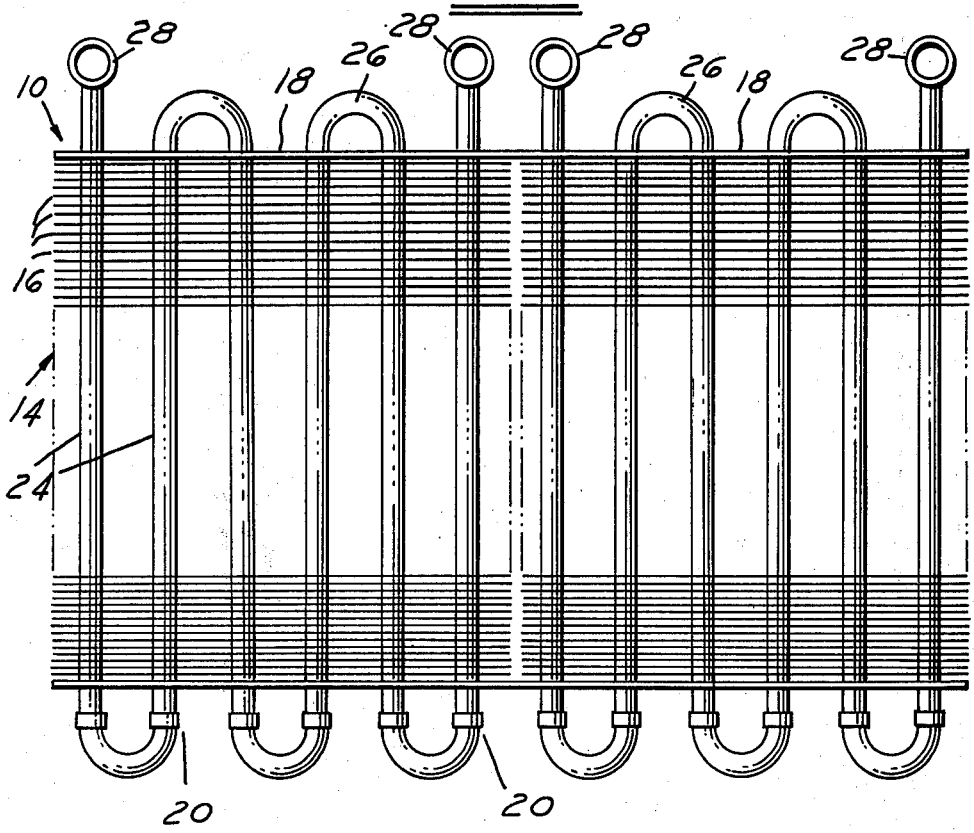
FIG. 2 is a side elevational view of the FIG. 1 arrangement.

Referring now to the drawings in greater detail, FIGS. 1 and 2 illustrate an assembly 10 of four heat exchanger units 12, each of which is an assembly of a core 14 including a pluraltiy of heat transfer fins 16 confined between a pair of end plates 18 and 20. A plurality of aligned aperatures 22 are formed in the end plates through which tubes 24 are inserted and expanded in order to be tightly fitted within the fins. The usual U-shaped end segments 26 are fastened on the ends of each adjacent pair of tubes 24 to provide communication therebetween. Appropriately aperatured lead tubes 28 are soldered to the ends of each of the end rows of tubes 24 for communication therewith.

As may be noted in FIG. 1, the four heat exchanger units 12 are separated from each other by a predetermined space, identified as 30. At the outer end of each space 30, a bridge tab 32 interconnects the edges of adjacent end plates 18 and 20, such that each end plate, and hence each unit 12, is connected at two diagonally opposite corners thereof to two other units, one aligned longitudinally and one aligned laterally therewith, resulting in the four unit assembly 10, as shown.

After assembly and shipping as a four unit arrangement, the four units can be readily separated by the use of a suitable cutting or nibbling tool, to cut through each bridge tab 32 (FIG. 3), and resulting in square corners 34, as shown in FIG. 4.

By referring now to FIGS. 5 and 6, it may be realized that alternate assemblies may include virtually any plurality of heat exchanger units, two and six such units being shown. Once again, bridge tabs 32 serve to connect adjacent outer corners of individual heat exchanger units 18. In the case of the FIG. 6 arrangement, the middle or intermediate row of units 18 are connected together at their adjacent inner corners, in order to make the total assembly rigid.

Industrial Applicability

It is apparent that the invention provides an improved arrangement for assuring that handling time and the possibility of damage to the usual heat exchanger fin faces would be substantially reduced during both assembly and shipping.

While three embodiments have been shown and described, other modifications thereof are possible.

The embodiments of the invention in which an exclusive property or privilege is claimed are defined as follows:

1. A heat exchanger arrangement comprising a plurality of individual heat exchanger assemblies, each including a separate fin pack confined between a pair of unitary end plates, a plurality of openings formed in said end plates, a plurality of tubes extended through said openings, a plurality of end segments interconnecting adjacent pairs of tubes of each heat exchanger assembly, said plurality of individual heat exchanger assemblies being arranged as a predetermined number of adjacent pairs, and connector means integrally interconnecting adjacent end plate outer corners only of each adjacent pair of assemblies.

2. A heat exchanger arrangement comprising a plurality of individual heat exchanger assemblies arranged in a predetermined number of adjacent pairs, each assembly including a separate fin pack confined between a pair of unitary end plates, a plurality of aligned openings formed in said end plates, a plurality of tubes extended through said aligned openings, a plurality of U-shaped end segments interconnecting adjacent pairs of tubes of each heat exchanger assembly, a bridge tab integrally interconnecting adjacent outer corners only of each adjacent pair of end plates such that said plurality of end plates are retained together as a unit during the assembly operations of said plurality of tubes and end segments thereto, and/or during shipment of said plurality of heat exchanger assemblies.

3. The heat exchanger arrangement described in claim 2, wherein said bridge tabs are defined by slots formed intermediate adjacent pairs of end plates.

4. The heat exchanger arrangement described in claim 3, wherein said slots are formed in an aligned configuration on opposite ends of said heat exchanger assemblies.

* * * * *